US006627007B2

(12) United States Patent
Andersson et al.

(10) Patent No.: US 6,627,007 B2
(45) Date of Patent: Sep. 30, 2003

(54) SURFACE MODIFIED STAINLESS STEEL

(75) Inventors: Jan Andersson, Sandviken (SE); Magnus Cedergren, Sandviken (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/897,051

(22) Filed: Jul. 3, 2001

(65) Prior Publication Data

US 2002/0014282 A1 Feb. 7, 2002

(30) Foreign Application Priority Data

Jul. 7, 2000 (SE) ..... 0002594

(51) Int. Cl.[7] ..... C22C 38/06; C22C 38/18

(52) U.S. Cl. ..... 148/320; 148/325; 148/529; 148/240; 148/277; 148/284; 148/285; 148/625; 420/62; 420/79

(58) Field of Search ..... 148/240, 529, 148/277, 284, 285, 320, 625, 325; 420/62, 79

(56) References Cited

U.S. PATENT DOCUMENTS 5,578,265 A 11/1996 Ericson et al.

6,355,212 B1 * 3/2002 Antolotti ..... 420/117

FOREIGN PATENT DOCUMENTS

| | | |
|---|---|---|
| GB | 574088 | 12/1945 |
| WO | 98/08986 | 3/1998 |

OTHER PUBLICATIONS

P. Y. Hou et al., "Effect of Reactive Element Oxide Coatings on the High Temperature Oxidation Behavior of a FeCrAl Alloy," *J. Electrochem. Soc.*, vol. 139, No. 4, Apr. 1992, pp. 1119–1126.

* cited by examiner

*Primary Examiner*—Roy King
*Assistant Examiner*—Andrew Wessman
(74) *Attorney, Agent, or Firm*—Burns, Doane, Swecker & Mathis, L.L.P.

(57) ABSTRACT

A method has been developed for surface modifications of high temperature resistant alloys, such as FeCrAl alloys, in order to increase their resistance to corrosion at high temperatures. Coating it with a Ca-containing compound before heat-treating builds a continuos uniform and adherent layer on the surface of the alloy, that the aluminum depletion of the FeCrAl alloy is reduced under cyclic thermal stress. By this surface modification the resistance to high temperature corrosion of the FeCrAl alloy and its lifetime are significantly increased.

7 Claims, 4 Drawing Sheets

* Standard FeCrAl alloy

Ca-coated FeCrAl alloy

SURFACE MODIFIED STAINLESS STEEL

The present invention relates generally to surface modified stainless steel with increased resistance to high temperatures. In particular, it relates to FeCrAl alloys that are modified by the application of a Ca-containing compound on their surface.

DESCRIPTION OF KNOWN ART

It is known art to use FeCrAl alloys for applications with high requirements for heat resistance, such as for example purification of automobile exhaust gases by using catalytic converters made of metallic substrates or electrical resistance heating applications. Aluminum is added to the alloy to form an alumina layer on the surface of the alloy after heat treating the alloy. This alumina is considered to be one of the most stable oxides having low oxidation rate at high temperatures. FeCrAl-alloys, forming aluminum oxide at exposure to high temperatures, e. g. above 1000° C., especially in thinner dimensions, for instance 50 $\mu$m foils for use in catalytic converters in the automobile industry, have a limited lifetime. This is due to breakaway oxidation, oxidation of Fe and Cr and that the matrix is depleted of Al after aluminum oxide formation after certain periods of time of use in cycles of high temperatures. Common conventional methods of increasing lifetime are the following:

alloying with Rare Earth Metals (REM) and/or Yttrium in order to increase the oxidation resistance of the FeCrAl alloy by supporting the forming of an aluminum oxide layer on the surface of the alloy.

increasing the aluminum content, or the contents of other elements with high oxygen affinity, in the matrix, which often leads to production difficulties such as embrittlement during rolling cladding the material with aluminum foils.

These methods have to rely on time consuming diffusion controlled processes. It is therefore an object of the present invention to provide a new approach how to increase the resistance to corrosion at high temperature, especially at cyclic thermal stress, and thereby increase the lifetime of said type of alloy.

DESCRIPTION OF THE INVENTION

By applying a continues uniform layer of a Ca-containing compound on the surface of the FeCrAl alloy before annealing, a mixed oxide of Al and Ca is formed during the heat treatment. This treatment gives the advantage of influencing, i e hindering, the aluminum oxide formation and nucleation already during the beginning of exposure to high temperature, which increases the lifetime more effectively than other methods, e g alloying or cladding. The surface has a more compact and homogenous oxide layer with less pores, dislocations and cavities than the hitherto known alumina layers formed on FeCrAl-alloys after heat treatment. The surface layer acts as barrier for aluminum ions and oxygen to diffuse through the alloy/oxide boundary and the oxidation resistance and lifetime of the alloy are therefore significantly improved. It is believed that the Ca-layer on the surface of the alloy tightens the surface in a way that the alumina depletion of the alloy is drastically reduced. Ca also favors the selective oxidation of Al, which improves the oxidation resistance at elevated temperatures and the lifetime of the alloy.

The appended figures are herewith briefly presented:

FIG. 1 shows a TEM-micrograph in 100 000× magnification of an embodiment of the present invention, in which A. FeCrAl alloy B. Columnar aluminum oxide grains.

C. Grain boundary in the oxide.

D. Calcium-containing layer filling in imperfections and grain boundaries in the oxide.

FIG. 2 shows typical results from the oxidation testing performed at 1100° C. for a period of 400 hours, showing the weight gain as a function of time for alloys according to the E. Present invention and F. Known Art.

COMPOSITION OF THE ALLOY TO BE COATED

Figure 1:
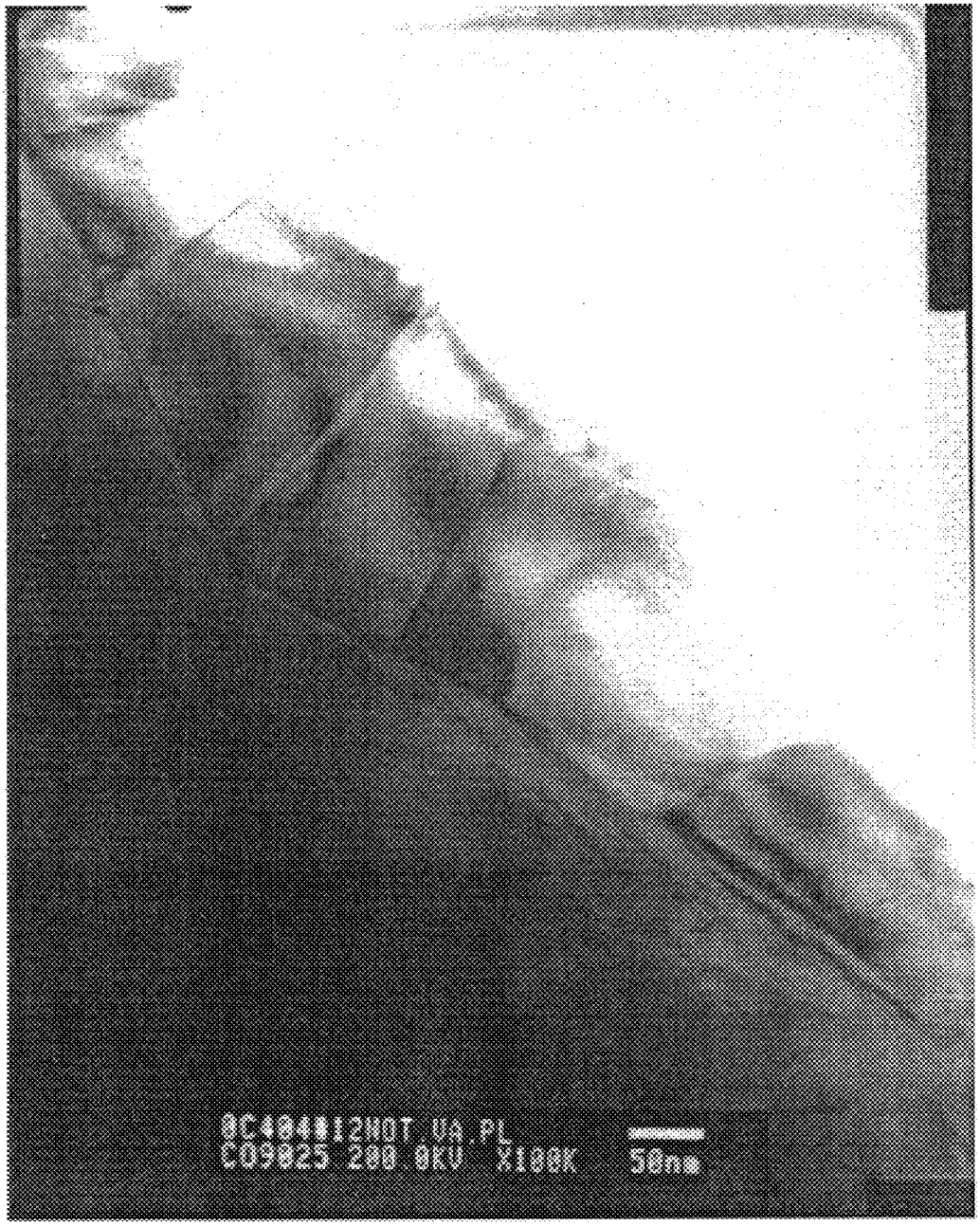

The alloy suitable for being processed according to the present invention includes hotworkable ferritic stainless steel alloys, normally referred to as FeCrAl alloys, that are resistant to thermal cyclic oxidation at elevated temperatures and suitable for thereon forming a protecting oxidelayer, such as an adherent aluminum oxide, said alloy consisting essentially (by weight) 10–40% Cr, 1.5–8.0% Al, preferably 2.0–8.0%, with or without an addition of REM elements at amounts up to 0.11%, up to 4% Si, up to 1% Mn and normal steelmaking impurities, the remainder being Fe. Such suitable ferritic stainless steel alloys are for instance those, disclosed in U.S. Pat. No. 5,578,265, which is hereby incorporated by reference and henceforth referred to as STANDARD FeCrAl alloy. These types of alloys are good candidates for final applications, which include electrical resistance heating elements and catalytic substrates such as used in catalytic systems and converters in the automotive industry.

An essential feature is that the material contains at least 1,5% by weight of aluminum to form alumina as a protective oxide on the surface of the alloy after heat treatment. The method is also applicable to composite materials, such as clad materials, composite tubes, PVD-coated materials, etc. wherein one of the components in the composite material is a FeCrAl alloy as mentioned above. The coated material may also be comprised of an inhomogeneous mixture of the alloying elements, for instance, a chromium steel coated with aluminum by for instance dipping or rolling, where the total composition for the material is within the limit specified above.

DIMENSIONS OF THE MATERIAL TO BE COATED

The coating method may be applied on any kind of product made of said type of FeCrAl alloy and in form strip, bar, wire, tube, foil, fiber etc., preferably in form of foils, that has good hot workability and which may be used in environments with high demands on resistance to corrosion at high temperatures and cyclic thermal stress. The surface modification will preferably be a part of a conventional production process, but care should of course be taken to other process stages and the final application of the product. It is another advantage of the method that the Ca-containing compound can be applied independently of the type of FeCrAl alloy or the shape of the part or material to be coated.

DESCRIPTION OF THE COATING METHOD

A broad variety of methods for the application of the coating media and the coating process may be used as long as they provide a continuous uniform and adherent layer. This may be techniques such as spraying, dipping, Physical Vapor Deposition (PVD) or any other known technique to apply a fluid, gel or powder of a Ca-containing compound on the surface of the alloy, preferably PVD such as disclosed in WO98/08986. It is also possible to apply the coating in the form of a fine-grained powder. The conditions for applying and forming the Ca-layer on the surface of the alloy may have to be determined experimentally in individual cases. The coating will be affected by factors such as temperature, time of drying, time of heating, composition and properties as well of the alloy as the Ca-containing compound.

Another important issue is that the sample should be cleaned in a proper way to remove oil residues etc., which may affect the efficiency of the coating process and the adhesion and quality of the coating layer.

It is an advantage if this surface modification is included into a conventional production process, preferably before the final annealing. The annealing may be performed in a non-oxidizing atmosphere during a suitable period of time at 800° C. up to 1200° C., preferably 850° C. to 1150° C. It is also possible to coat the material in several steps to attain a thicker Ca-layer on the surface of the FeCrAl-alloy. In this case one could use different kinds of Ca-containing compound to reach denser layers. For example it might be convenient to use a Ca-containing compound that adheres well to the metal surface in the first layer and then apply a Ca-containing compound which has a better performance in building a uniform and dense Ca-layer to improve the resistance to high temperature corrosion at cyclic thermal stress.

Furthermore, it might also be possible to apply the coating at different production stages. As an example one could mention cold rolling of thin strips. For example you might repeatedly roll, clean and anneal the strip several times. Then it might be convenient to apply the coating before each annealing. In this way, the nucleation of the oxide will be enhanced, even though, in applicable cases, the subsequent rolling operation to some extent may destroy the oxide layer partly. For instance it might also be possible to use different kinds of Ca-containing compounds in each step to reach optimum adhesion and quality of the coating layer and to adapt the coating step to the other steps of the production process.

DEFINITION OF THE Ca-CONTAINING COMPOUND

Several different types of Ca-containing compounds, with different compositions and concentrations as described below, may be applied as far as they contain sufficient amounts of Ca in order to obtain a continuos and uniform layer of Ca, that has a thickness of between 10 nm and 3 $\mu$m, preferably between 10 nm and 500 nm, most preferably between 10 nm and 100 nm and contains between 0.01 wt-% and 50 wt-% of Ca, preferably 0.05 wt-% up to 10 wt-%, most preferably 0.1 wt-% up to 1 wt-%, on the surface of the material. The type of the Ca-containing compound should of course be selected corresponding to the used technique to apply the coating and the production process in total. The compound may for instance be in the form of a fluid, gel or powder. Experiments showed for example god results for colloidal dispersion with a Ca-content of approximately 0.1 vol-%.

Without intending to be bound by this, a few specific examples of calcium containing compounds, which leave Calcium on the surface and could be used, alone or in combination, are:

a) Soap and degreasing solvents.

b) Calcium nitrate.

c) Calcium carbonate.

d) Colloidal dispersions.

e) Calcium stearate.

f) Calcium oxides.

In the case of fluid compounds the solvent may be of different kinds, water, alcohol etc. The temperature of the solvent may also vary because of different properties at different temperatures.

Experiments have shown that it is favourable for the coating to have a wide variety in grain size of the Ca-containing compound. A wide variety supports the adherence of the layer on the surface of the FeCrAl alloy. Furthermore, cracks in the Ca-containing surface layer occuring under drying will be avoided. As a result of practical testing it could be stated that drying, if included as a step in the production procedure, should not be carried out at temperatures over approximately 200° C. in order to avoid cracking of the Ca-rich layer. If the size of the Ca-grains exceeds to an amount of approximately 100 nm with a wide variation of grain sizes, the best results for adhesion and homogeneity of the coating layer were obtained. The same result could be obtained if the coating will be carried out in several steps and/or with different Ca-containing compounds in order to obtain a dense film on the surface of the alloy. The time period for the drying should be limited to approximately 30 seconds.

DESCRIPTION OF AN EMBODIMENT OF THE INVENTION

Figure 2:
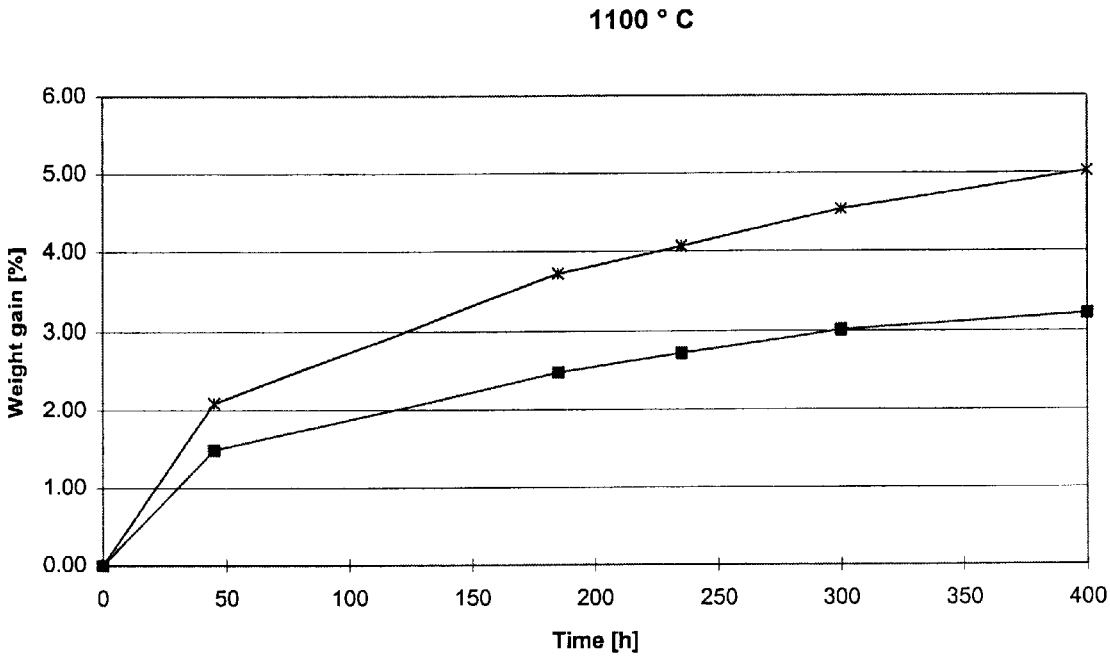

A foil 50 $\mu$m thick of standard FeCrAl alloy was dipped in a soap solution, dried in air at room temperature and thereafter heat treated for 5 seconds at 850° C. After the coating process samples (30×40 mm) were cut out, folded, cleaned with pure alcohol and acetone. Then the samples were tested in a furnace in 1100° C., normal atmosphere. The weight gain was then measured after different periods of time. This FeCrAl foil with a coating according to the invention had a weight gain of 3,0% after 400 h. A standard, uncoated FeCrAl alloy had a weight gain of 5,0% after 400 h. See FIG. 2. This means in practice a more than doubled lifetime of the foil material Ca-coated according to the invention.

Figure 3:
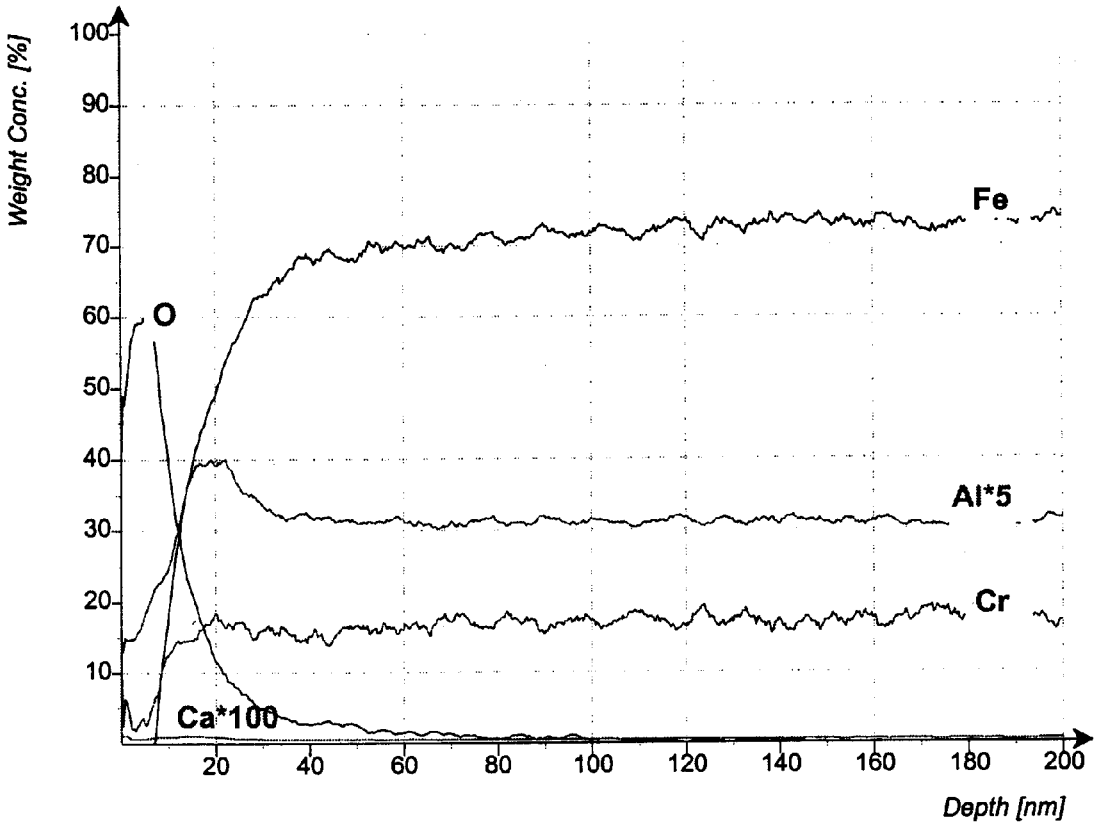
FIG. 3 shows an example of a depth profile measurement on an annealed but not coated material.
Figure 4:
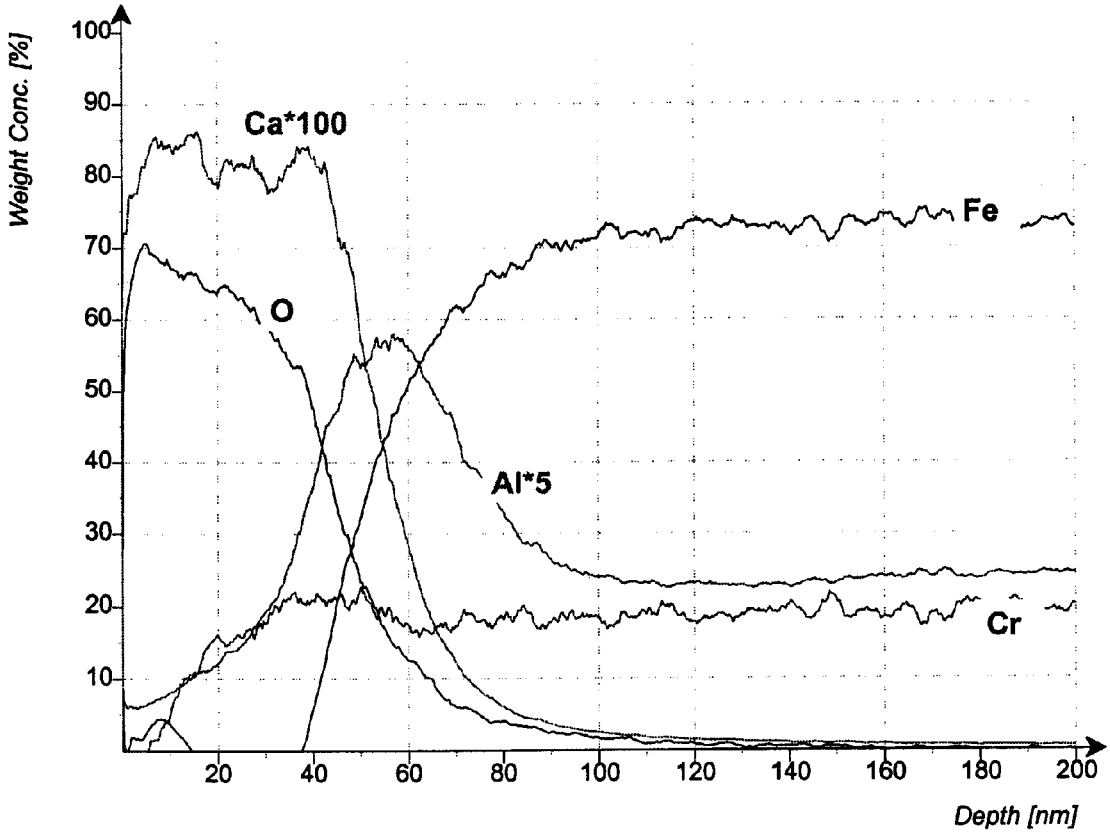
FIG. 4 shows, in the same way, an example of a coated material according to the present invention. In this case, there is found a layer on the surface with a thickness of approximately 50 nm, rich in Calcium.

The cross section of the surface layer was analyzed using Glow Discharge Optical Emission Spectrometry (GD-OES). Using this technique it is possible to study the chemical composition of the surface layer as a function of the distance from the surface into the alloy. The method is very sensitive for small concentrations and it has a depth resolution of a few nanometers. The result of the GD-OES analysis of the standard foil is shown in FIG. 3. There only exists a very thin passivation layer on this material. The foil according to the invention is shown in FIG. 4. From FIG. 4 it is apparent that the Ca-enriched surface layer is about 45 nm thick.

The primary technique for the classification of the materials after the coating process and annealing is of course the oxidation testing. However, using GD-OES and TEM-microscopy etc., it has been possible to adjust the process and to explain the influence of critical parameters, such as concentration of the coating media, thickness of the coating, temperature etc.

What is claimed is:

1. A heat resistant FeCrAl-alloy material with improved oxidation resistance, comprising a Ca-enriched surface layer having a Ca content of 0.01–50 wt-%, and the surface layer comprising a mixed oxide of Ca and Al.

2. The material according to claim 1, wherein said Ca-enriched surface layer is 10 nm to 3 $\mu$m thick.

3. The material according to claim 1, wherein said surface layer has a maximum Ca-content of 0.1–10 wt-%.

4. The material according to claim 1, wherein the FeCrAl alloy comprises (by weight) 10–40% Cr, 1.5–10% Al, up to 4% Si, up to 1% Mn, the remainder being iron and normal steelmaking impurities.

5. The material according to claim 2, wherein said Ca-enriched surface layer is 10 nm–500 nm thick.

6. The material according to claim 2, wherein the Ca-enriched surface layer is formed from at least one of: soap and degreasing solvents, calcium nitrate, calcium carbonate, colloidal dispersions, calcium stearate and calcium oxides.

7. The material according to claim 4, wherein the FeCrAl alloy comprises at least one of REM elements and yttrium in an amount up to 0.11 wt-%.

* * * * *